US007578714B2

(12) United States Patent
MacKay

(10) Patent No.: US 7,578,714 B2
(45) Date of Patent: Aug. 25, 2009

(54) SWIMMING GLOVE

(76) Inventor: Arthur E. MacKay, 33 Saxon Wood Rd., White Plains, NY (US) 10605

( * ) Notice: Subject to any disclaimer, the term of this patent is extended or adjusted under 35 U.S.C. 154(b) by 12 days.

(21) Appl. No.: 12/005,754

(22) Filed: Dec. 28, 2007

(65) Prior Publication Data

US 2009/0075536 A1 Mar. 19, 2009

(51) Int. Cl.
*A63B 31/02* (2006.01)
*A41D 25/00* (2006.01)

(52) U.S. Cl. ..... 441/57; 2/158

(58) Field of Classification Search ..... 441/57
See application file for complete search history.

(56) References Cited

U.S. PATENT DOCUMENTS 742,440 A 10/1903 Johnson
1,712,655 A * 5/1929 Fibiger ..... 441/57
1,664,187 A 9/1961 Glass, Jr.
3,122,760 A 3/1964 Glass, Jr.
3,174,167 A 3/1965 Pauley
3,874,014 A 4/1975 Davey
4,383,336 A 5/1983 Beckman et al.
4,669,991 A * 6/1987 Southworth ..... 441/57
4,746,313 A 5/1988 Bray et al.
4,892,496 A 1/1990 Vondruska
4,893,372 A 1/1990 Wenzel
4,964,824 A 10/1990 Spencer et al.
5,172,427 A 12/1992 Van Bergen et al.
6,581,211 B1 6/2003 Golden

* cited by examiner

*Primary Examiner*—Jesus D Sotelo
(74) *Attorney, Agent, or Firm*—Milde & Hoffberg, LLP

(57) ABSTRACT

A hand covering for controlling the stroking power of hand is provided. The hand covering includes a tubular shaped body-cover for bringing the hand in a covered state. The hand covering includes one or more insert members disposed within the body-cover of the hand covering. The insert members extend the body-cover beyond the fingers. Further, one or more slits are provided on the body-cover for bringing the hand in an exposed state from the covered state. The exposed state allows the hand covering to be rolled back onto the wrist of the user.

21 Claims, 10 Drawing Sheets

SWIMMING GLOVE

BACKGROUND OF THE INVENTION

The present invention relates, in general, to a hand covering. More specifically, the present invention relates to a hand covering for controlling the stroking power of the hand while swimming.

Various types of gloves are known in the art that increase the stroking power of the hand of a user while swimming. Typically, the gloves include receptacles to receive the fingers of the user. The user wears the glove while swimming to enhance the stroking power of the hand. A webbing material may be attached to some or all of the receptacles to increase the effective surface area of the glove. The increase in the surface area enables the user to increase the stroking power of the hand while swimming. Further, the increase in the surface area also increases the resistance to the flow of water while swimming. However, the surface area of the glove is not adjustable by the user while swimming. This may lead to an undesirable stress on the muscles and joints of the user even when the increase in surface area is not required. The use of such webbed gloves may create an injury due to the undesirable stress on the muscles and joints of the user.

Conventional web style swimming gloves are of fixed size and shape that fits onto the fingers of the user. Moreover, the material of glove reduces the flexibility of the user to stretch the fingers inside the glove. Further, the webbed glove has a single opening for wearing and removing of the glove. This structure of the webbed glove makes the wearing and removing of the gloves time consuming for the user.

In light of the foregoing discussion, there is a need of a glove that may be used by the user to reduce the undesirable stress on the muscles or joints during swimming.

There is a need for a glove that enables the user to adjust the surface area of the hands to control the stoking power while swimming.

Further, there is a need of a glove to be comfortably worn and removed from the hand by the user while swimming.

SUMMARY OF THE INVENTION

An object of the present invention is to provide a hand covering or "swimming glove" for controlling stroking power of the hand of a user while swimming.

Another object of the present invention is to provide a swimming glove that can be rolled back onto the wrist of user when not in use.

Embodiments of the present invention provide a hand covering for controlling the stroking power of the hand of a user. The hand covering includes a body-cover with two open ends, such as a first open end and a second open end. The body-cover receives the hand through the first open end and brings the hand in a covered state. The hand covering includes one or more insert members disposed within the body-cover for supporting the body-cover in a flattened condition when in use. The insert members are moveable within the body-cover and may extend the surface area of the body-cover beyond the fingers of the user. In another embodiment of present invention, the insert members are retained inside a pocket that is attached to the body-cover. The second open end, such as a slit, is provided on the body-cover for bringing the hand from the covered state to an exposed state. The exposed state allows the glove to roll back to the wrist of the user to form a wrist band.

Various embodiments of the present invention provide a swimming glove for controlling the stroking power of the user while swimming. The glove includes flat support members that may increase the surface area of the glove. The increased surface area of the glove enhances the stroking power of the user while swimming. Moreover, the slit on the glove allows the glove to slide down onto the wrist of the user when not in use.

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
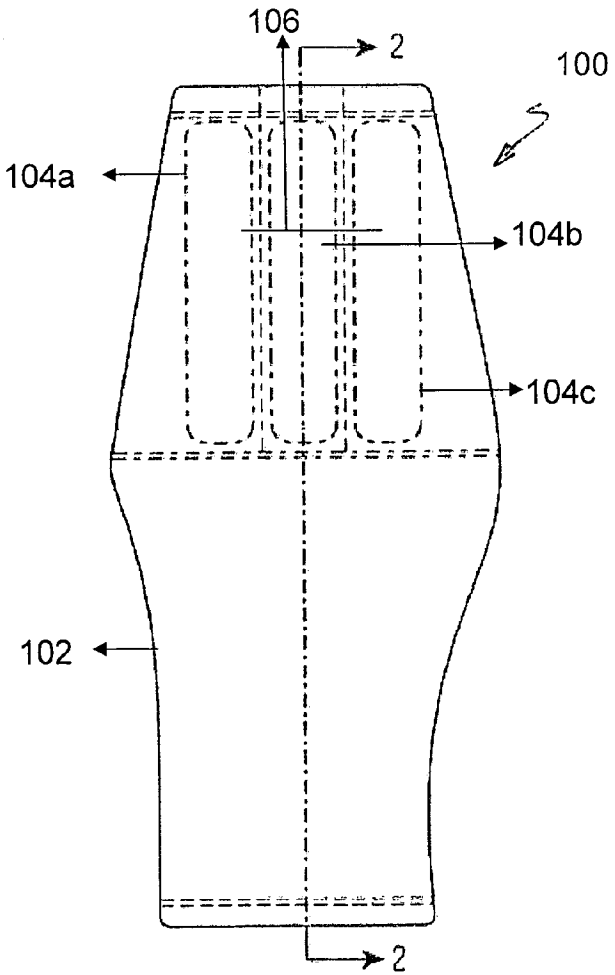
FIG. 1 illustrates a front view of a glove, in accordance with a preferred embodiment of the present invention.

Embodiments of the present invention describe a hand covering. In the description herein for embodiments of the present invention, numerous specific details are provided, such as examples of components and/or mechanisms, to provide a thorough understanding of embodiments of the present invention. One skilled in the relevant art will recognize, however, that an embodiment of the present invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Embodiments of the present invention describe a hand covering to control stroking power of the hand of a user. Various embodiments of the present invention provide a hand covering that includes a body-cover, one or more insert members and one or more slits. The body-cover brings the hand to a covered state. The insert members are disposed within the body-cover for supporting the body-cover in a flattened condition when in use. The insert members adjust the surface area of the body-cover to control the stroking power of the hand during swimming. The insert members may extend the body-cover beyond the fingers of the user to increase the surface area of the body-cover. A slit is provided on the body-cover for bringing the hand from the covered state to an exposed state. The user removes the body-cover from the fingers through the slit to bring the hand to the exposed state. The exposed state allows the glove to roll back to the wrist of the user. The rolled back position of the glove frees the fingers from the body-cover and provides dexterity to the hand.

Reference will now be made in detail to several embodiments of the invention that are illustrated in the accompanying drawings. Wherever feasible and convenient, same reference numerals are used in the FIGS. and the description to refer to the same or like parts. The drawings are in a simplified form and not to precise scale. For purposes of convenience and clarity only, directional terms, such as top, bottom, left, right, up, down, over, above, below, beneath, rear, and front may be used with respect to the accompanying drawings. These and similar directional terms should not be strictly construed to limit the scope of the invention. In addition, words such as couple, connect, and similar terms with their inflectional morphemes are used interchangeably, unless the difference is noted or made otherwise clear from the context. These words and expressions do not necessarily signify direct connections, but include connections through mediate components and devices.

FIG. 1 illustrates a front view of a hand covering 100, in accordance with an embodiment of the present invention. Hand covering 100 may be worn on either hand of a user and is intended to control the stroking power of the hand while swimming. Examples, of hand covering 100 may include, but are not limited to, a glove and a mitten. Hand covering 100 is hereinafter referred to as glove 100.

Glove 100 includes a body-cover 102, one or more insert members such as an insert member 104*a*, an insert member 104*b* and an insert member 104*c*, and one or more slits, such as a slit 106. Further, glove 100 is divided along a section line 2-2 and the corresponding sectional view has been illustrated in FIG. 2.

According to various embodiments of present invention, body-cover 102 is a tubular sleeve-like covering of suitable size and shape that fits the hand and the forearm of the user. Body-cover 102 has an opening for receiving the hand of the user. Body-cover 102 brings the hand in a covered state with the hand being placed inside body-cover 102. In an embodiment of the invention, body-cover 102 is made of a flexible material that allows the fingers to stretch away from each other in the covered state. Body-cover 102 provides an adjustable area to the hand for the movement and stretching of the fingers. The stretching of the fingers increases the surface area of body-cover 102. The increase in the surface area increases the resistance to the flow of the water. For example, insert members 104*a*, 104*b* and 104*c* increases the surface area during backward stroke of the user while swimming. In an embodiment of the present invention, the surface area may be adjusted to reduce the stress on the muscles and joints of the user while swimming. For example, insert members 104 are moved to the center of body-cover 102 during the forward stroke to reduce the stress on the user.

The insert members 104*a*, 104*b* and 104*c* are hereinafter referred to as insert members 104. As shown in FIG. 1, insert members 104 are longitudinally aligned with respect to section line 2-2 within body-cover 102. The orientation of insert members 104 with respect to each other and with respect to body-cover 102 assists in controlling propulsion efficiency in the water. For example, insert members 104 may extend body-cover 102 beyond the fingers to increase the surface area of body-cover 102 and provide greater resistance to the flow of water. In an embodiment as shown FIG. 1, insert members 104 are aligned parallel to the section line 2-2.

According to various embodiments of present invention, insert members 104 are flat support members that are disposed within body-cover 102 adjacent to one end of body-cover 102. Insert members 104 provide support to body-cover 102 in a flattened condition when in use. Insert members 104 in the flattened condition provide a greater resistance to the flow of water while swimming. The flattened condition of body-cover 102 increases the stroking power of the hand. Moreover, insert members 104 provide resistance against bending of body-cover 102 along the section line 2-2. Insert members are explained in detail in conjunction of FIG. 2 of the present invention.

Slit 106 is placed on body-cover 102 to bring the hand from the covered state to an exposed state. The exposed state is the position of the hand in which the fingers are removed from body-cover 102 of glove 100 through slit 106. Body-cover 102 may be rolled back to the wrist of the user in the exposed state of the hand. The exposed state frees the fingers and enhances the dexterity of the fingers for any hand work desired by the user. For example, the exposed state permits the user to easily grasp and manipulate objects such as opening and closing of a life jacket. Further, insert members 104 roll along with body-cover 102 on the wrist of the user. Slit 106 has been explained in detail in conjunction with FIG. 3 and FIG. 4 of the present invention.

In accordance with an embodiment of the present invention, glove 100 is made of a flexible material. It should further be understood that the term 'flexible material' here defines a material with a four-way stretching capability. Although a material with the four-way stretching capability is preferable, other material with substantial stretching properties may also be employed.

In an embodiment of the present invention, glove 100 may be made of any suitable flexible material that is water impermeable, such as spandex, plastic or latex (natural or synthetic). Glove 100 also maintains a suitable temperature for the hand to enable the user to swim comfortably.

Figure 2:
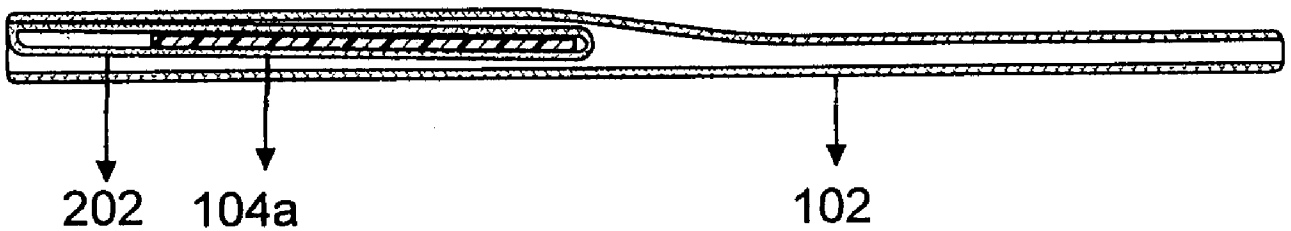
FIG. 2 illustrates a sectional view of insert members taken along the section line 2-2 of FIG. 1.

FIG. 2 illustrates a sectional view of insert members 104 along section line 2-2 of FIG. 1, in accordance with an embodiment of the present invention. Body-cover 102 includes a pocket 202. As shown in FIG. 2, insert members 104 are retained in pocket 202 within body-cover 102. In various embodiments of the present invention, the user may place the fingers on either side of pocket 202.

Insert members 104, in pocket 202, may be moved to extend the body-cover 102 beyond fingers. The fingers may be stretched in the extended state of body-cover 102 to form an outstretched configuration of glove 100. The outstretched configuration increases the surface area of glove 100 by forming an extended cup. The extended cup increases the resistance of glove 100 to the flow of the water and enhances the propulsion efficiency of the user while swimming. Details pertaining to the outstretched configuration have been explained in conjunction with FIG. 12.

In an embodiment of the present invention, insert members 104 are made of plastic or relatively rigid material. Insert members 104 are of suitable length to allow body-cover 102 to extend beyond the fingers. In an embodiment of the present invention, insert members 104 is approximately one-half foot in length.

Figure 3:
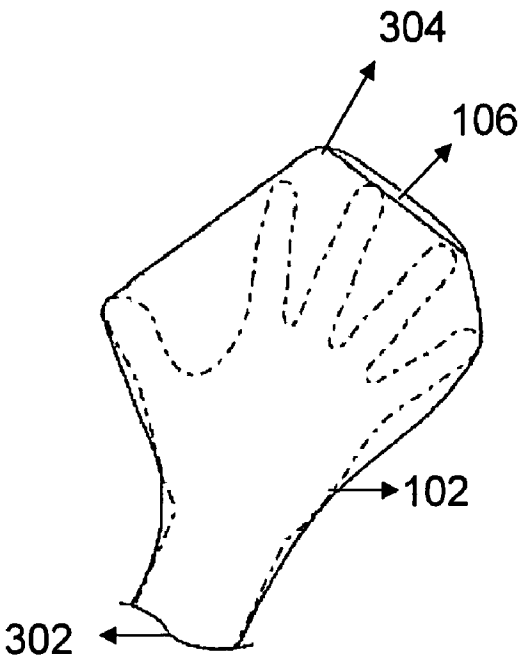
FIG. 3 illustrates a front view of the hand in a covered state, in accordance with a preferred embodiment of the present invention.

FIG. 3 illustrates a front view of the hand in the covered state, in accordance with an embodiment of the present invention. In an embodiment as shown in FIG. 3, the fingers are stretched in a covered state to attain a stretched configuration of glove 100. In the stretched configuration the fingers are spread in the covered state to form a cup shape of glove 100. The cup shape enables the displacement of the water during swimming. The cup shape of glove 100 increases the surface area of glove 100. The increased surface area enhances the stroking power of the user while swimming. Details pertaining to the stretched configuration of glove 100 have been explained in conjunction with FIG. 11 of the present invention.

In an embodiment of the present invention as shown in FIG. 3, body-cover 102 is the tubular sleeve having two open ends, such as a first open end and a second open end. Body-cover 102 receives the hand through the first open end at a distal end 302 of glove 100. The second open end is slit 106 that is present at a proximal end 304 of glove 100. In an embodiment of the invention, the length of body-cover 102 is approximately one foot between the distal end and the proximal end of glove 100.

One or more fastening members (not shown in FIG. 3) are attached to body-cover 102. The fastening members provide the opening and closing of slit 106. The fastening members may be affixed to body-cover 102 or may be removable therefrom.

Figure 4:
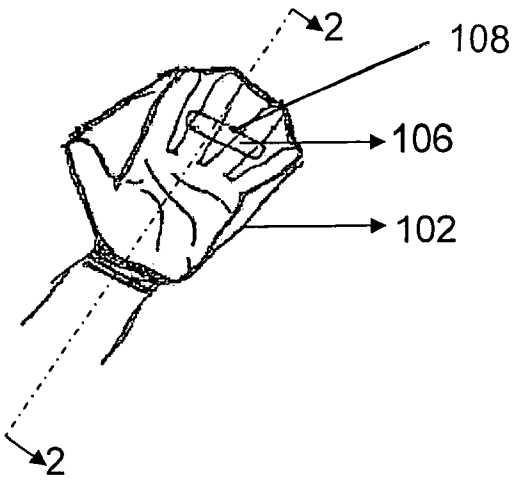
FIG. 4 illustrates a front view of the hand in a covered state, in accordance with another embodiment of the present invention.

FIG. 4 illustrates a front view of the hand in the covered state, in accordance with an embodiment of the present invention. As shown in FIG. 4, slit 106 is an elongated opening on the body-cover 102 to remove the fingers from body-cover 102 without removing glove 100 from the first open end. In an embodiment as shown in FIG. 4, slit 106 extends laterally and is positioned substantially perpendicular with respect to axis 2-2. In an alternative embodiment, slit 106 may extend longitudinally and is positioned substantially parallel with respect to axis 2-2. In various embodiments of the present invention, slit 106 may be extended and aligned in other directions with respect to axis 2-2.

Further, slit 106 is provided with one or more fastening members 108 to fasten slit 106. Examples of the fastening members include, but are not limited to, Velcro strips, buckles, fasteners and snaps.

Figure 5:
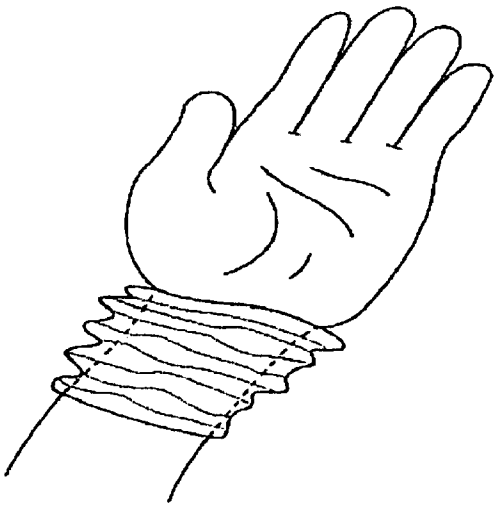
FIGS. 5, 6 and 7 illustrate a front view, a side view and a top view respectively, of the hand in an exposed state, in accordance with an embodiment of the present invention.
Figure 6:
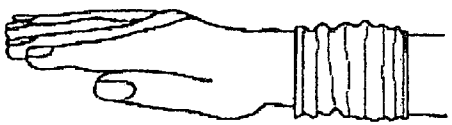
Figure 7:
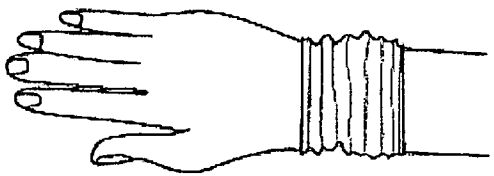

FIGS. 5, 6 and 7 illustrate a front view, a side view and a top view respectively, of the hand in the exposed state, in accordance with an embodiment of the present invention. The fingers are removed from body-cover 102 through slit 106 to attain the exposed state. According to various embodiments of the invention, body-cover 102 is rolled on to the wrist of the user as shown in FIGS. 5, 6 and 7 of the present invention. In an embodiment of the present invention, the user may slide glove 100 on to the wrist when the user does not require assistance in propulsion.

Figure 8:
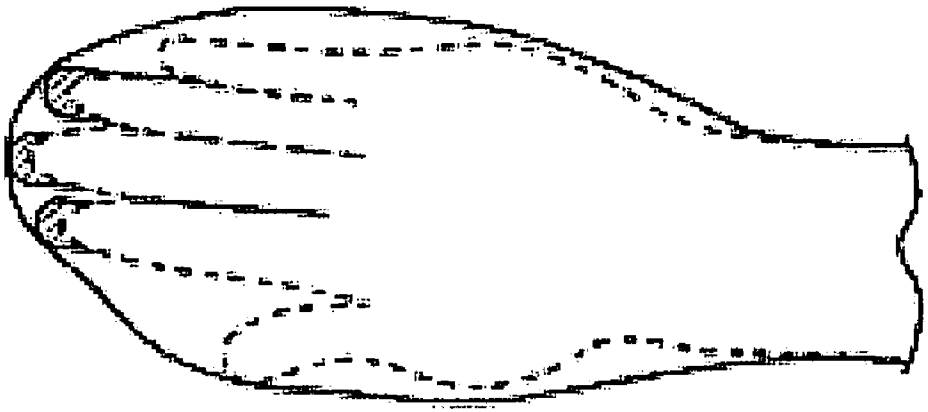
FIG. 8 illustrates a top view of the hand placed inside the glove, in accordance with an embodiment of the present invention.

FIG. 8 illustrates a top view of the hand placed inside glove 100, in accordance with an embodiment of the present invention. As shown in FIG. 8, the user places the fingers on insert members 104 in a relaxed position. In an embodiment of the present invention, the fingers are in relaxed position during the forward stroke.

Insert members 104 may be extended to increase the surface area of glove 100. Details regarding extension of insert members 104 have been explained in FIG. 2 of the present invention. In an embodiment of the present invention, insert members 104 may be moved to the center of body-cover 102, when the user does not require assistance in propulsion. Further, insert members 104 are made of flexible plastic material that can be easily rolled back along with body-cover 102 to the wrist of the user.

Figure 9:
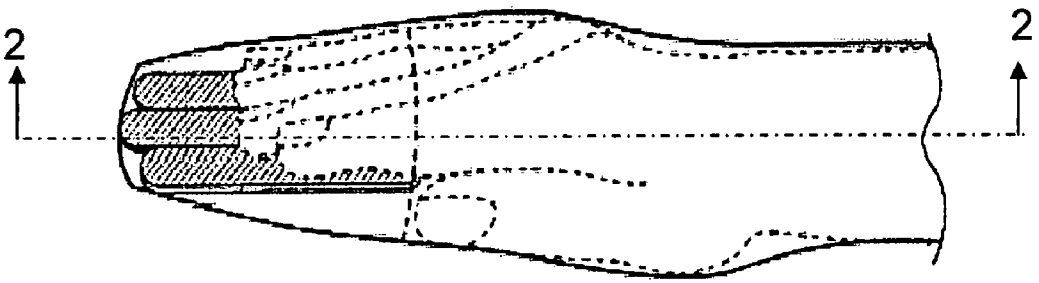
FIGS. 9 and 10 illustrate side views of the glove, in accordance with an embodiment of the present invention.
Figure 10:
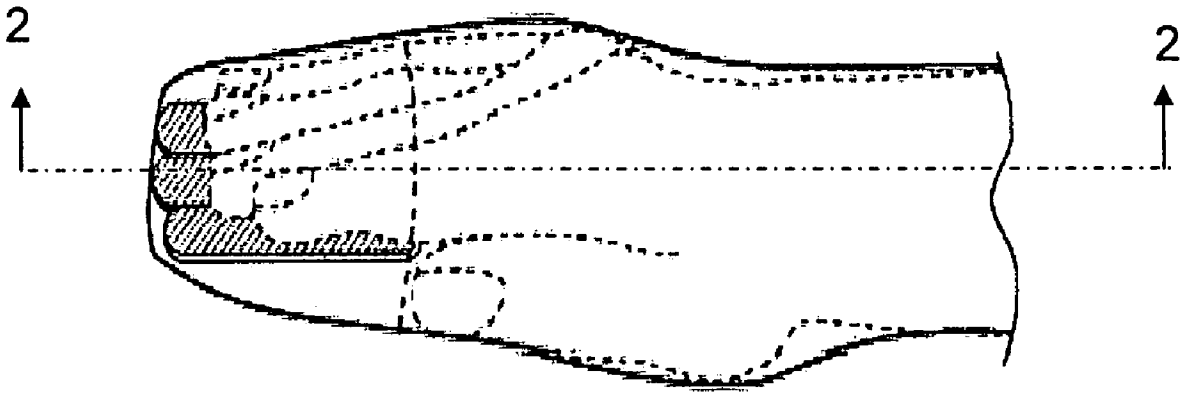

FIGS. 9 and 10 illustrate side views of glove 100, in accordance with an embodiment of the present invention. Insert members 104 are extended outward to increase surface area of glove 100 beyond the fingers. Further, as shown in FIG. 10 of the present invention, insert members 104 are retracted to reduce the surface area of glove 100. In an embodiment of the present invention, the movement of insert members 104 is substantially parallel with respect to axis 2-2, as shown in FIG. 9 and FIG. 10 of the present invention. The movement of insert members 104 allows the user to control the stroking power while swimming.

Figure 11:
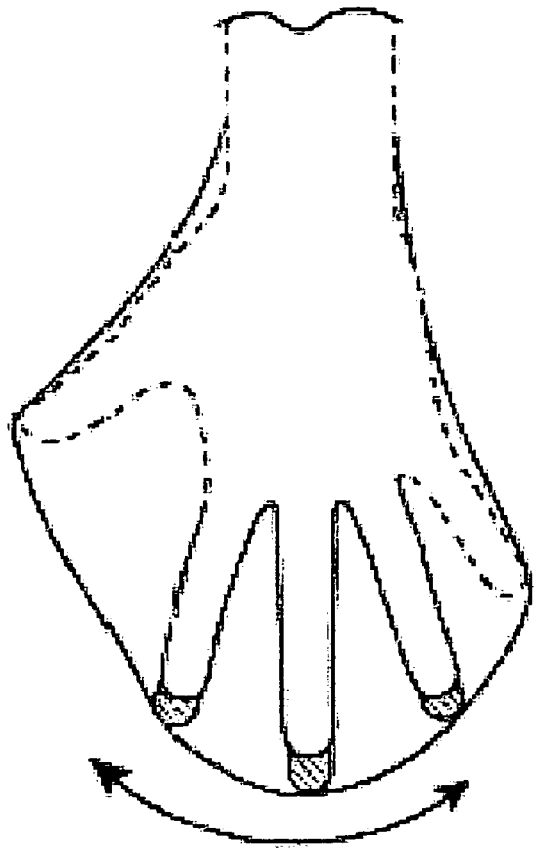
FIG. 11 illustrates a top view of the hand in a stretched configuration of the glove, in accordance with an embodiment of the present invention.

FIG. 11 illustrates a top view of hand in a stretched configuration of glove 100, in accordance with an embodiment of the present invention. The fingers are placed over insert members 104 in the stretched position. Details pertaining to said stretched position have already been explained in FIG. 3 and FIG. 4 of the present invention.

Figure 12:
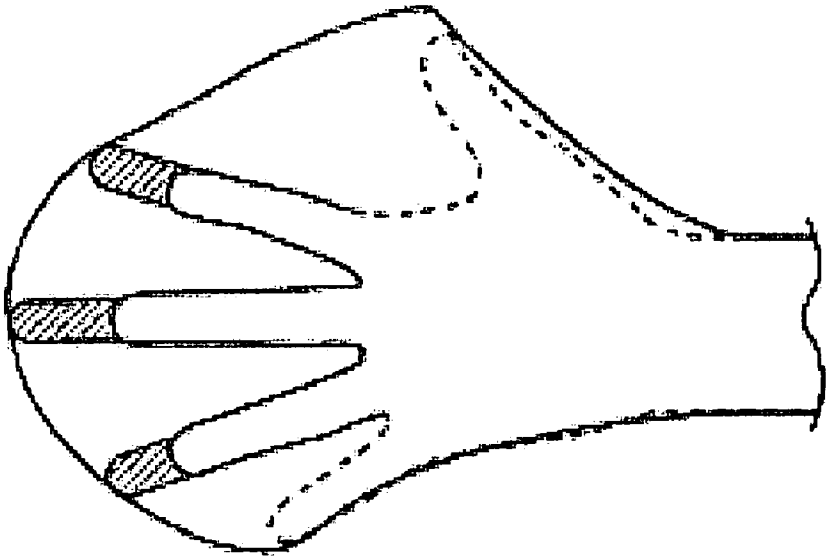
FIG. 12 illustrates a top view of the hand in an outstretched configuration of the glove, in accordance with an embodiment of the present invention.

FIG. 12 illustrates a top view of hand in the outstretched configuration of glove 100, in accordance with an embodiment of the present invention. Insert members 104 provide support to body-cover 102 in a flattened position. The outstretched position is achieved by extending insert members 104 and spreading the fingers. The outstretched position provides an increase in the surface area of glove 100.

It is contemplated that glove 100 may be manufactured from a stretchable material to accommodate for different sizes of the hand. Alternatively, glove 100 may be manufactured in a variety of sizes based on the sizes of the hand.

A specific embodiment of glove 100 according to the present invention has been described for the purpose of illustrating the manner in which the invention may be made and used. It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

What is claimed is:

1. A mitten hand covering for increasing water resistance to hand motion when swimming, said hand covering comprising, in combination:

(a) a tubular sleeve body made of flexible material and having two open ends, said body being of suitable size and shape to fit over a wearer's hand and forearm, said body forming a mitten over the wearer's hand covering all fingers of the hand together;

(b) at least one relatively rigid, flat support member for supporting the body in a flattened condition when in use, said support member being disposed within the body so as to be superimposed over at least one finger of the wearer's hand when the hand covering is in use.

2. The hand covering defined in claim 1, wherein the support member is retained within the body adjacent one end.

3. The hand covering defined in claim 2, wherein the support member is retained in a pocket within the body.

4. The hand covering defined in claim 3, wherein the pocket is attached to the body only at said one end, thereby permitting the wearer's hand to be on either side of the support member when in use.

5. The hand covering defined in claim 2, wherein said at least one support member comprises a plurality of support members extending from said one end toward the center of the body.

6. The hand covering defined in claim 5, comprising two support members.

7. The hand covering defined in claim 5, comprising three support members.

8. The hand covering defined in claim 1, wherein said body is made of Spandex.

9. The hand covering defined in claim 1, wherein said at least one support member is made of plastic.

10. The hand covering defined in claim 1, wherein said body is approximately one foot in length between its open ends.

11. The hand covering defined in claim 1, wherein said support member is approximately one-half foot in length.

12. A glove for controlling stroking power of the hand, the glove having an opening for receiving the hand, the glove comprising:

(i) a pocket;

(ii) one or more slits on the pocket for bringing the hand from a covered state to an exposed state, wherein the exposed state allows the pocket to roll onto the wrist of the user; and (iii) one or more insert members placed inside the pocket, wherein the insert members extend the pocket beyond the fingers.

13. The glove according to claim 12, wherein the pocket allows the fingers of the hand to stretch away from each other.

14. The glove according to claim 12, further comprising one or more fastening members coupled to the pocket, wherein the fastening members cover the slits.

15. The glove according to claim 14, wherein the fastening members are Velcro.

16. The glove according to claim 12, wherein the glove is made of a flexible material.

17. The glove according to claim 12, wherein the insert members are made of plastic material.

18. A glove for a hand, the glove comprising:

(i) a pocket for bringing the hand in a covered state, wherein the pocket allows the fingers of the hand to stretch away from each other;

(ii) one or more slits on the pocket for bringing the hand from the covered state to an exposed state, wherein the exposed state allows the pocket to roll onto the wrist of the user;

(iii) one or more fastening members coupled to the pocket, wherein the fastening members cover the slits; and (iv) one or more insert members placed inside the pockets, wherein the insert members extend the pocket beyond the fingers.

19. The glove according to claim 18, wherein the fastening members are Velcro.

20. The glove according to claim 18, being made of a flexible material.

21. A mitten hand covering for increasing water resistance to hand motion when swimming, said hand covering comprising, in combination:

(a) a tubular sleeve body made of flexible material and having two open ends, said body being of suitable size and shape to fit over a wearer's hand and forearm;

(b) at least one relatively rigid, flat support member, disposed within the body, for supporting the body in a flattened condition when in use;

wherein the support member is retained within the body adjacent one end;

wherein the support member is retained in a pocket within the body; and wherein the pocket is attached to the body only at said one end, thereby permitting the wearer's hand to be on either side of the support member when in use.

* * * * *